United States Patent [19]

Janicki

[11] Patent Number: 4,759,697

[45] Date of Patent: Jul. 26, 1988

[54] ROTARY PISTON MACHINE HAVING CROWN WHEEL COUPLED TO THE CRANK

[76] Inventor: Jean C. Janicki, 13 rue du Colonel Driant, 54220 Malzeville, France

[21] Appl. No.: 51,204

[22] Filed: May 18, 1987

Related U.S. Application Data

[63] Continuation of Ser. No. 791,434, Oct. 25, 1985, abandoned.

[30] Foreign Application Priority Data

Nov. 13, 1984 [FR] France ..... 84 17307

[51] Int. Cl.[4] ..... F04C 18/46

[52] U.S. Cl. ..... 418/57; 418/65

[58] Field of Search ..... 418/57, 63-67

[56] References Cited

U.S. PATENT DOCUMENTS 1,692,639 11/1928 Elsner ..... 418/57

FOREIGN PATENT DOCUMENTS

| | | | |
|---|---|---|---|
| 2509536 | 9/1976 | Fed. Rep. of Germany | 418/57 |
| 582267 | 10/1924 | France | 418/57 |
| 1256125 | 2/1961 | France . | |
| 2280808 | 2/1976 | France . | |
| 2468770 | 5/1981 | France . | |
| 2470267 | 5/1981 | France . | |

*Primary Examiner*—John J. Vrablik

*Attorney, Agent, or Firm*—Ostrolenk, Faber, Gerb & Soffen

[57] ABSTRACT

A rotary piston machine with a chamber having a crank coaxial to a shaft, a rotary piston and a crown wheel for driving the piston. The crown wheel is coupled to the crank by a trunnion mounted in a bore of the crank. A fork joint is integral with the crown wheel. The bore axis is offset in the direction of rotation of the shaft with respect to the point of contact of the piston on the wall of the chamber. A spring bears on a shoe integral with the crown wheel and on the crank so that the line of force of the spring passes through the axis of the shaft and is prependicular to the straight line connecting the center of the piston and the center of the trunnion.

13 Claims, 10 Drawing Sheets

Figure 1:
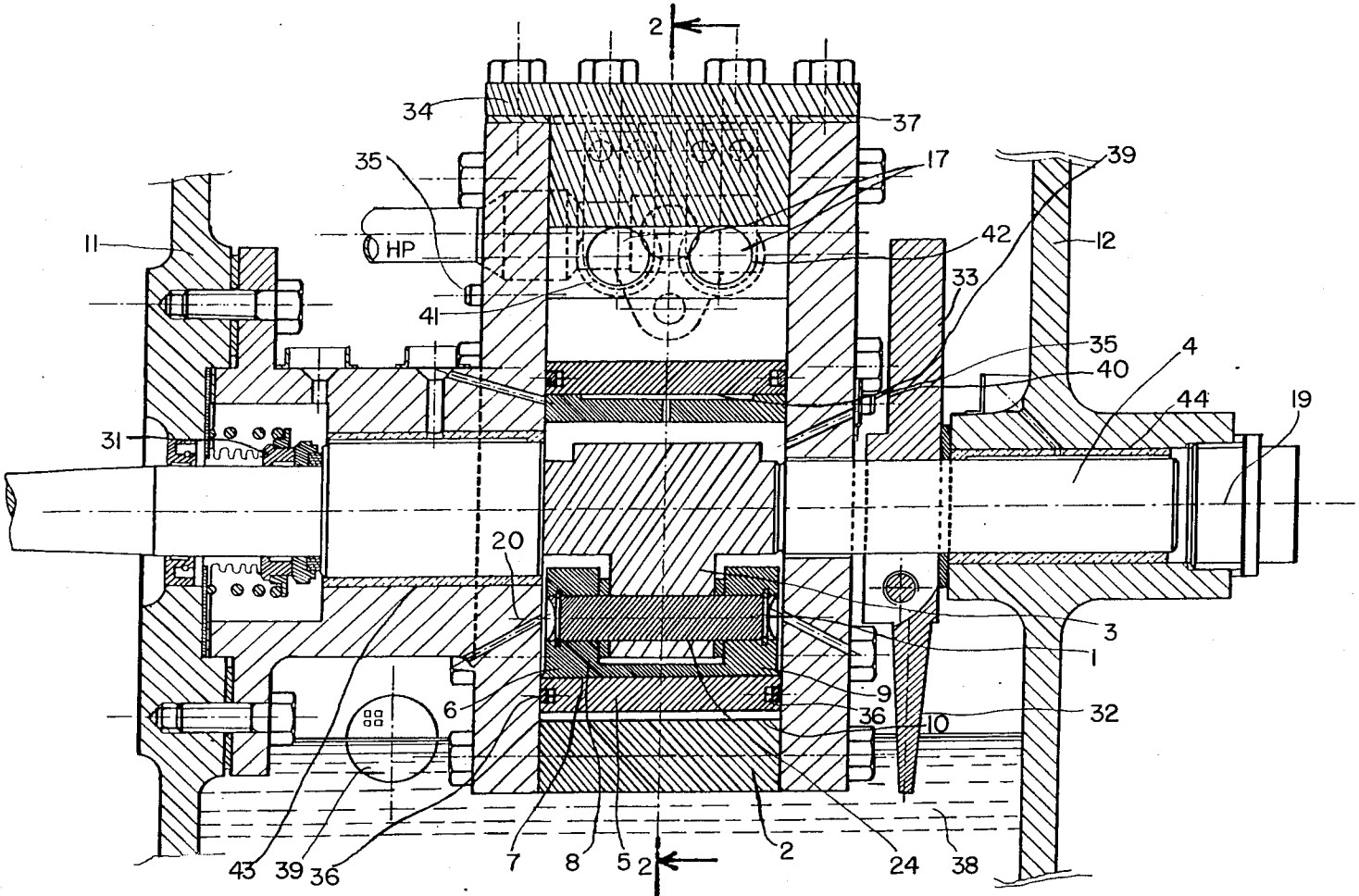

FIG 15
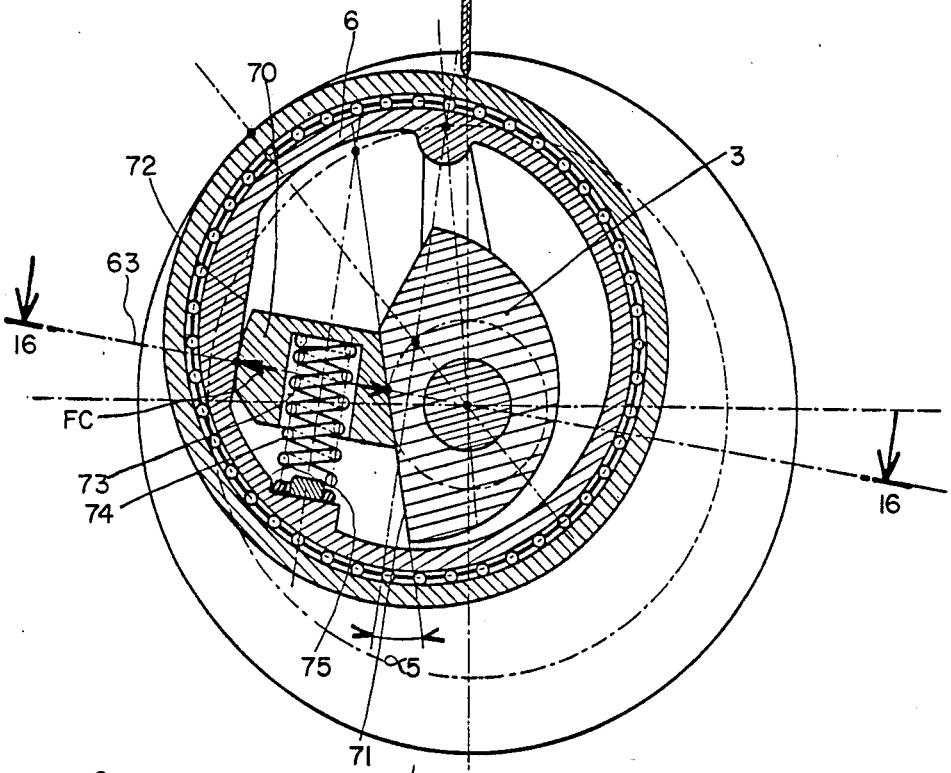
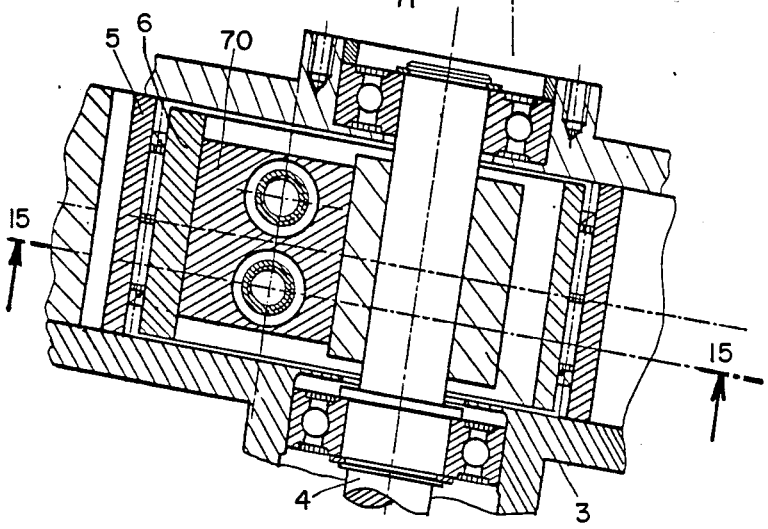
FIG 16

ROTARY PISTON MACHINE HAVING CROWN WHEEL COUPLED TO THE CRANK

This application is a continuation of application Ser. No. 791,434 filed on Oct. 25, 1985, now abandoned.

The present invention relates to rotary piston machines, particularly rotary piston compressors, comprising a cylindrical chamber in which are disposed an excentric part or crank of a shaft coaxial with said chamber, an annular rotary piston rolling in contact with the wall of the chamber and a crown wheel for driving the piston mounted with a clearance there inside, the piston being adjusted on its rolling path by resilient means.

Such machines are known as well as the problems arising from construction thereof and more especially the machining tolerances and assembly of the parts for providing sealing of the piston on its rolling path, when no play take up system has been provided. Lift-off of the piston may be more particularly observed in the zone where the rolling contact point between the piston and the bore of the chamber approaches dead center, that is to say the discharge orifice situated upstream of the flap separating the high pressure compartment from the low pressure compartment. For high rotational speeds and low working pressures, the centrifugal forces originating in the mobile crown wheel-piston assembly are sufficient to oppose such lift-off. This is however not the case for low speeds and high pressures and several solutions have been thought up for overcoming this problem and for ensuring engagement of the piston with the bore of the chamber and delaying lifting up thereof.

Some constructions, such as described in French Patent No. 2 468 770 and No. 2 470 267 require a very delicate mechanical adjustment of the piston on the stator, for it cannot allow take up of play and requires a very high assembly accuracy.

According to another proposal, French Patent No. 2 280 808, lifting only of the piston is delayed by keeping the angle formed between the straight line connecting the center of the chamber to the center of the piston with the straight line connecting this latter center to the center of the excentric to an optimum value situated between 20° and 40°.

In another construction, French patent No. 1 256 125, the rotor is formed by a cylindrical jacket freely mounted in the chamber about the shaft and held in contact with the wall of said chamber through a mobile mounting rolling device, which consists of a lever fixed on the shaft and having at one end a roller and at the other end an arm ending in a roller, the spring being provided for moving the arm away from the lever.

Such a solution, in which the cylindrical jacket is free in the stator is not free of drawbacks for the jacket may transfer a shock on start up into the flap separating the compartments of the chamber. In addition, it requires a very accurate calculation of the admissible rotational speeds of the rollers as a function of the maximum rotational speeds of the piston, so as to guarantee the life span of the compressor.

In another construction, French patent No. 2 275 664, the piston rolls freely on a ball bearing outside a ring integral with the excentric of the shaft. Attempts have been made to overcome the problem of lifting by using the principle of a knuckle joint lever, by placing the center of the piston at the center of the excentric or in the zone between the center of the excentric and the center of the rotary piston in the vicinity of the center of the excentric. Such a solution is delicate to realise, for the least imbalance of the rotating masses causes vibrations and oscillations harmful for the bearings of the compressor.

In another construction, French patent No. 2 223 570, recommending the mounting of the rotary piston on an excentric drive crown wheel integral with the excentric of the shaft, the angle which the straight line connecting the axis of the shaft to the axis of the excentric part forms with the straight line which connects this latter axis to the central axis of the excentric crown wheel is between 70° and 110°, so that the piston rolls while being applied against the inner wall of the casing and so that, once a certain lifting pressure reached, the piston moves away from the wall of the casing. Such a compressor does not provide mechanical engagement of the piston during operation but only driving of the piston through the excentric crown wheel.

The present invention provides then a machine in which both correct driving of the piston and engagement thereof on the bore of the chamber are provided, while preventing lifting thereof in the high pressure zone, without such a construction comprisinq a mechanical assembly with adjustment of the excentric or assembly on a ball bearing directly on the excentric, requiring necessarily expensive accuracy during machining and assembly of the machine.

In accordance with the invention, the rotary piston machine, more especially a rotary piston compressor, comprising a cylindrical chamber in which are disposed an excentric part or crank of a shaft coaxial with said chamber, an annular rotary piston able to roll in contact with the wall of the chamber and a coaxial crown wheel for driving the piston mounted there inside, so as to be able to slide with respect to the piston, engagement of the piston on its rolling path being provided by resilient compensation means bearing on the crank or shaft and on the bore of the crown wheel, further comprising a flap dividing the free space about the piston in to two variable volume compartments is characterized in that the crown wheel is rotated by means of a member coupling the crank and the crown wheel so as to be able to pivot about a common axis.

Different coupling means may be provided, the coupling member is preferably a trunnion mounted in a fork joint.

In a preferred embodiment, the trunnion is mounted in a bore of the crank and in a fork joint integral with the crown wheel. The reverse solution may also be provided, a fork joint integral with the crank and a bore formed in the crown wheel.

Engagement of the piston on its rolling path may be provided by different resilient compensation means with progressive adjustment.

In a first variant, a spring is mounted transversely upstream of the contact point between the piston and the wall of the chamber with respect to the direction of rotation bearing on the crown wheel and on the crank so that the straight line of action of the spring passes through the axis of the shaft and is perpendicular to the straight line connecting the center of the piston to the center of the trunnion. Preferably, the spring is housed between a centering stud fixed to the crown wheel and a cylindrical housing formed in the crank, the bottom of the housing being parallel to the straight line connecting together the centers of the piston and the crank.

As a variant, the resilient engagement means are formed by at least one wedge with conical slope urged by a spring working under compression along a straight line of action transverse to the axis of the shaft. In a preferred embodiment, one of the longitudinal faces of the crank has two longitudinal concave portions inclined with respect to the axis of the shaft and forming a housing with the bore of the crown wheel, two wedges being housed at the ends of said housing, each one having an inner face slanting by an angle corresponding to that of the inclined portion, a spring being disposed between the wedges. The part of the crown wheel on which the wedges bear has a flat portion, whereas the outer face of each wedge bearing thereon has a rounded profile.

In another arrangement, a housing is disposed between the bore of the crown wheel and the crank having a slope on the crank side which is slanted transversely with respect to the straight line connecting the center of the piston to the center of the trunnion, the action of the wedge housed in this housing and urged by a spring being exerted along a straight line transverse with respect to the shaft. The wedge in this case has a longitudinal face with a slope corresponding to the slope of its housing on the crank side.

Figure 2:
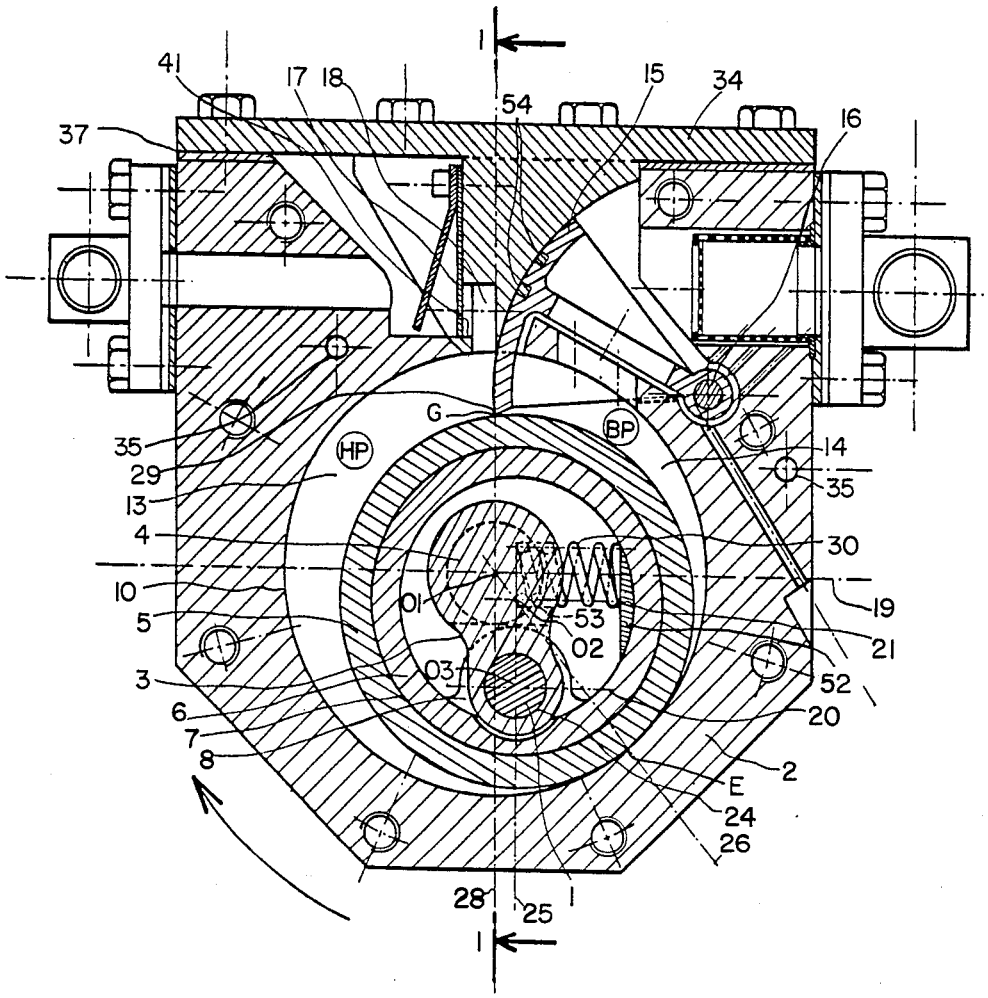
Figure 3:
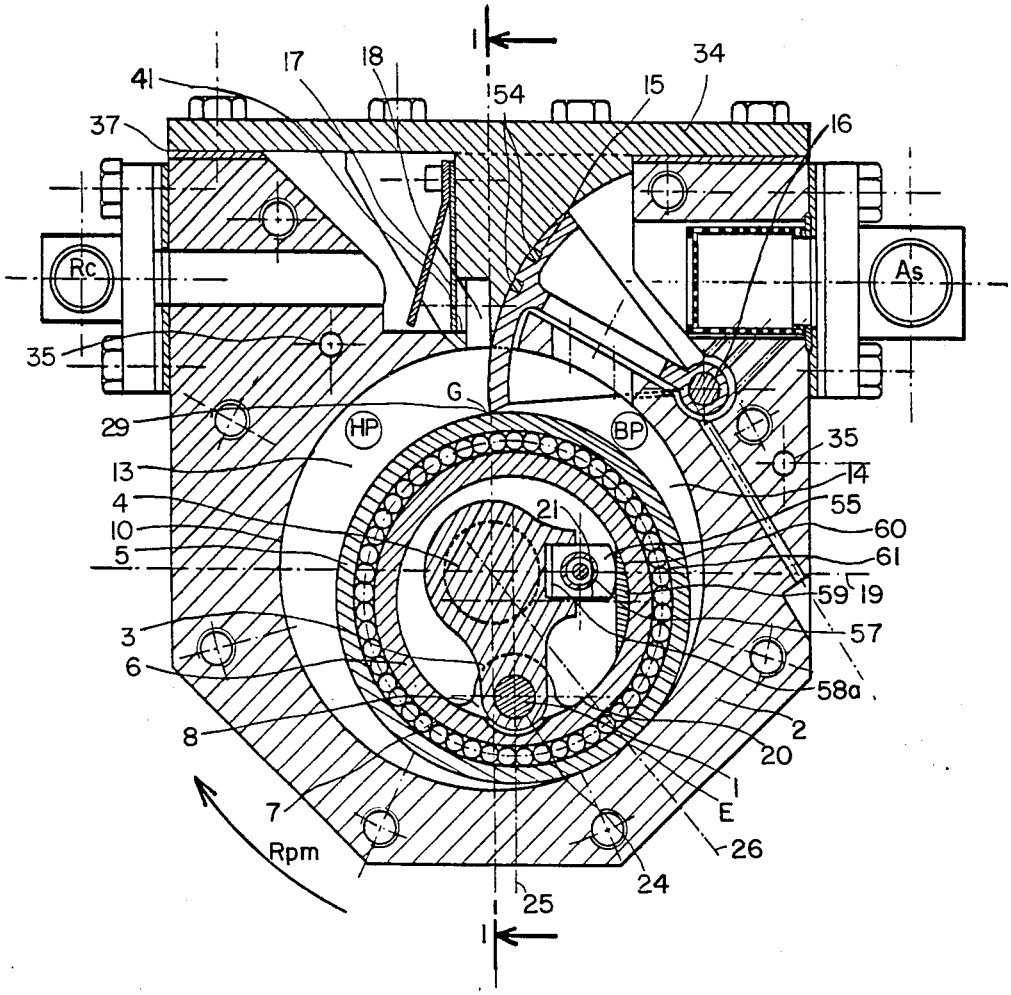
Figure 4:
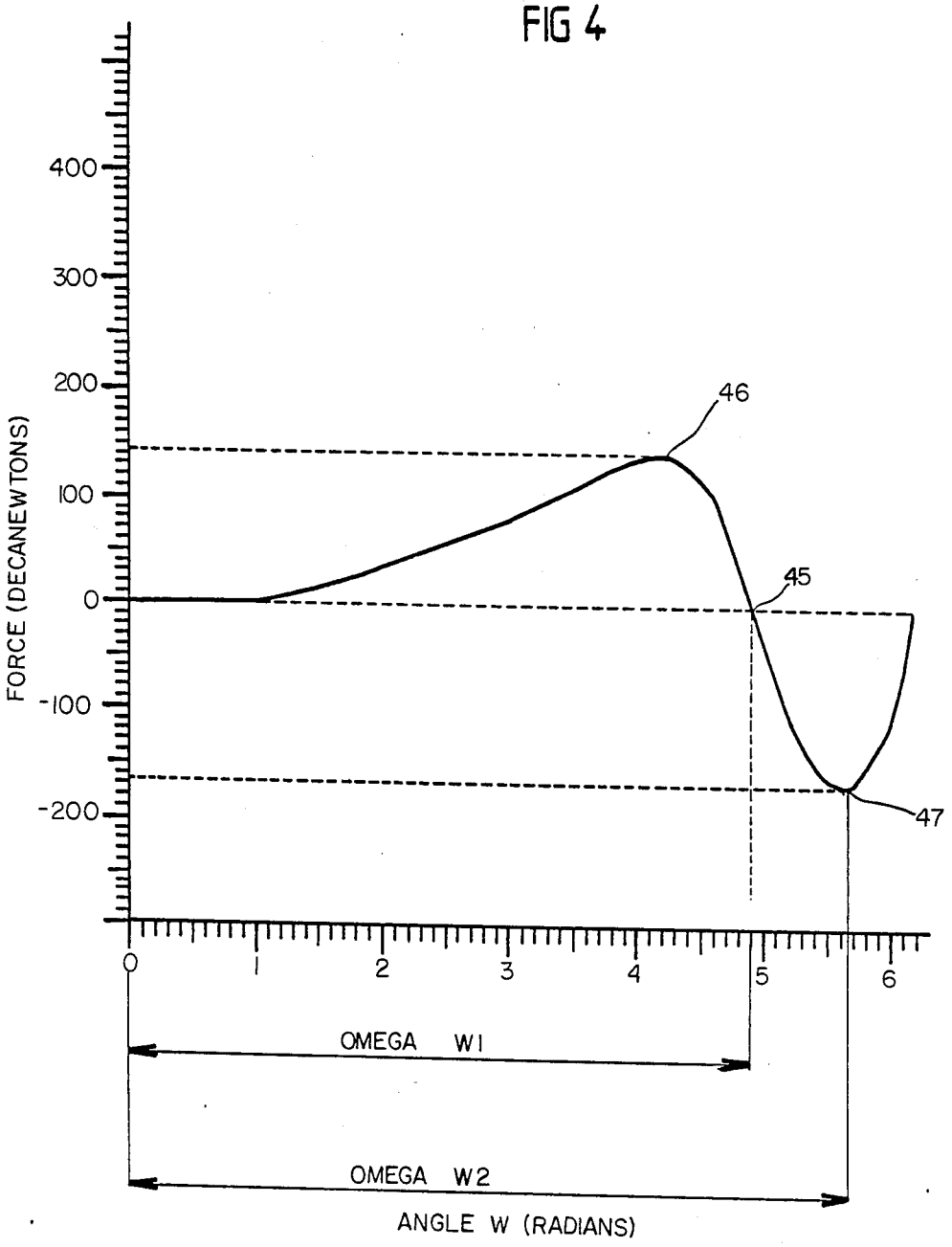
Figure 5:
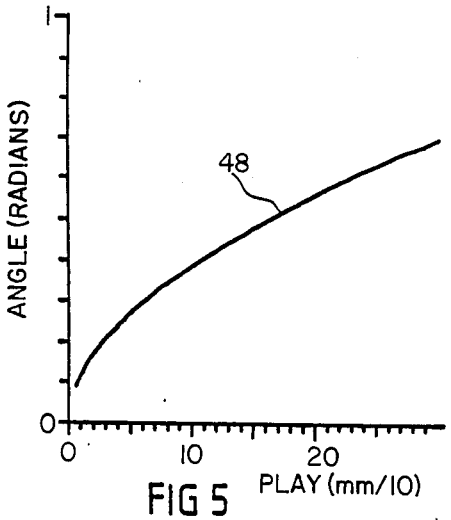
Figure 6:
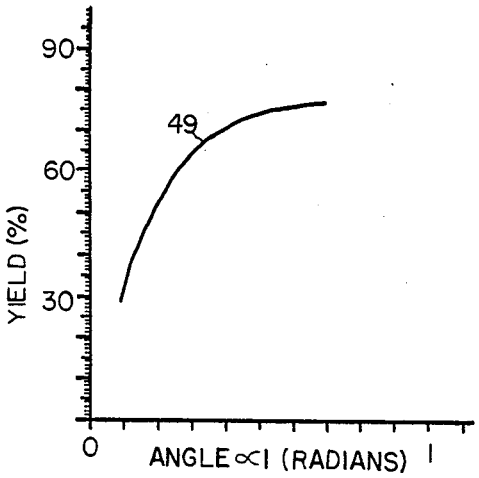
Figure 7:
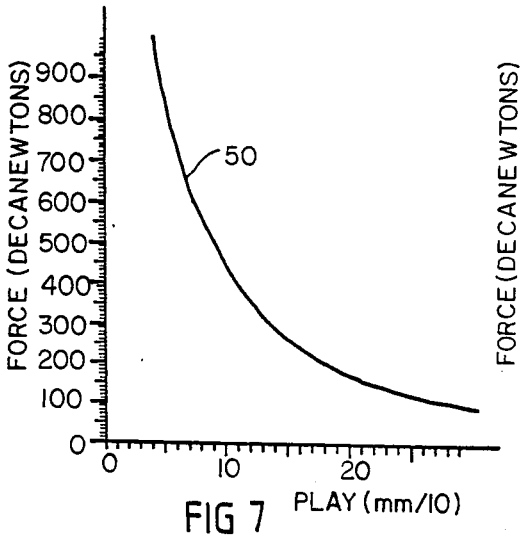
Figure 8:
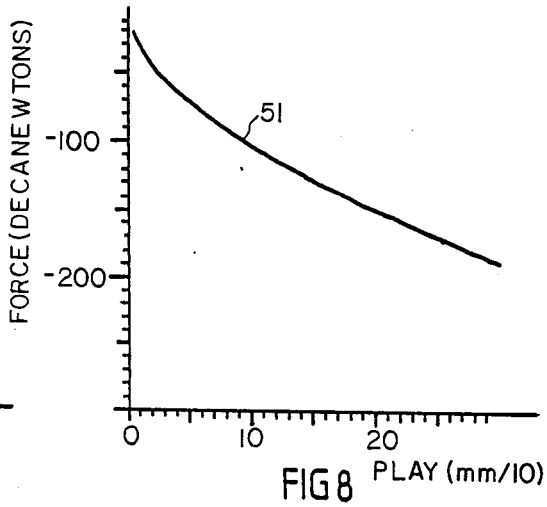
Figure 9:
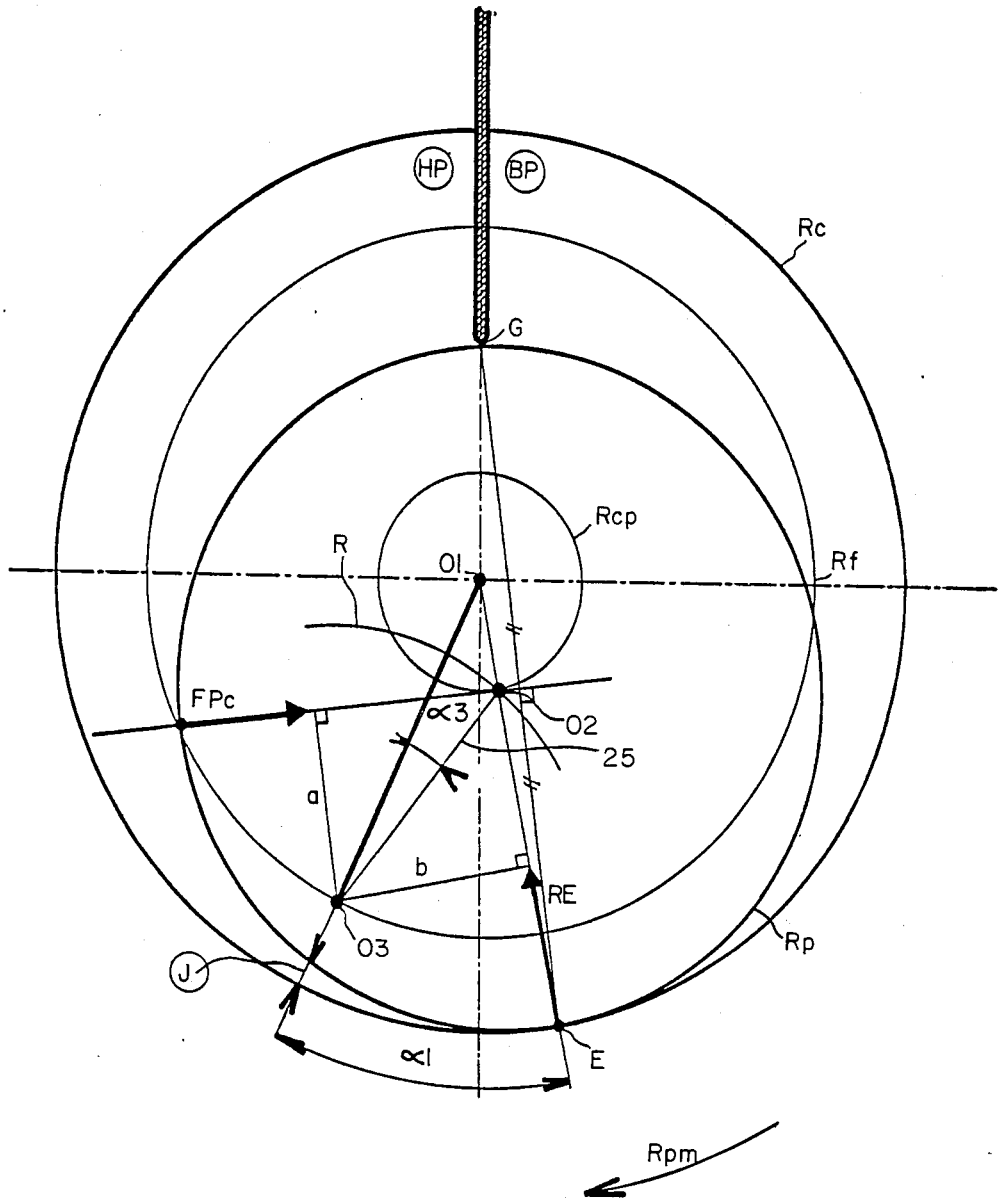
Figure 10:
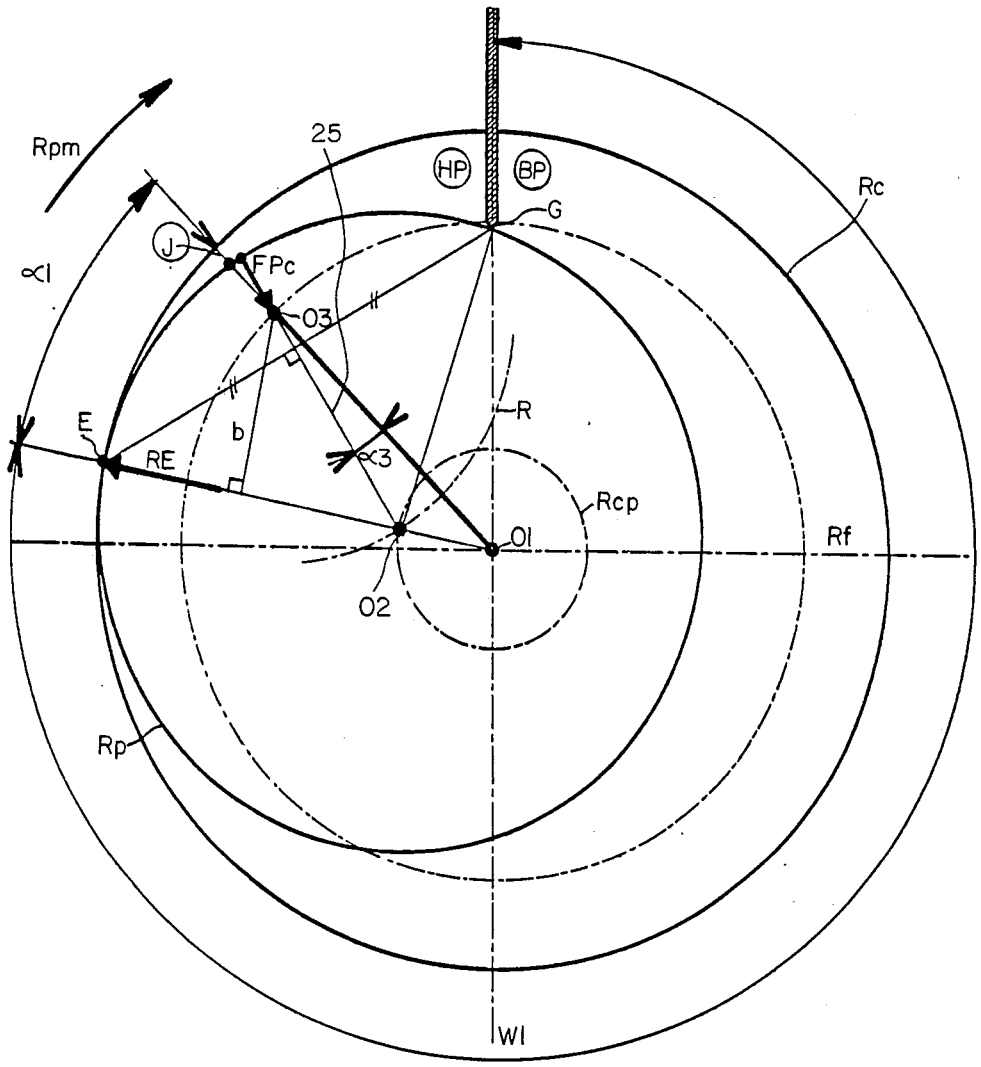
Figure 11:
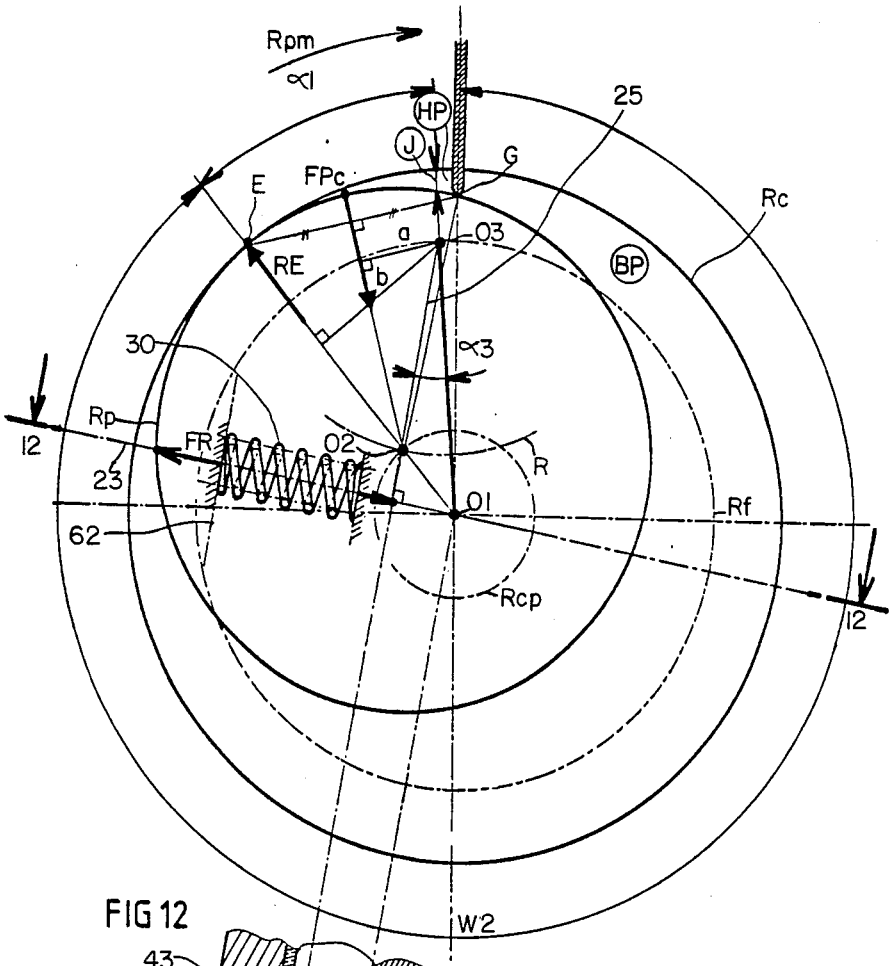
Figure 12:
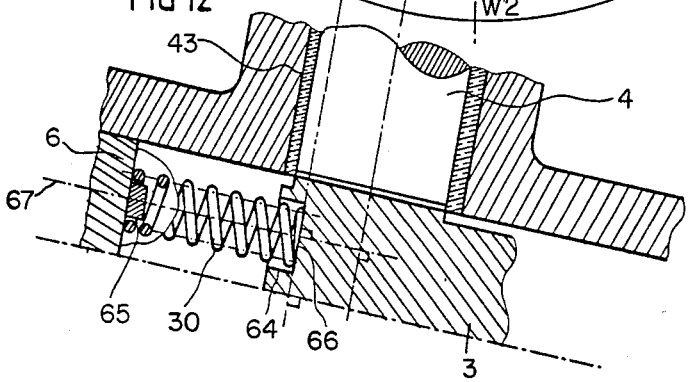
Figure 13:
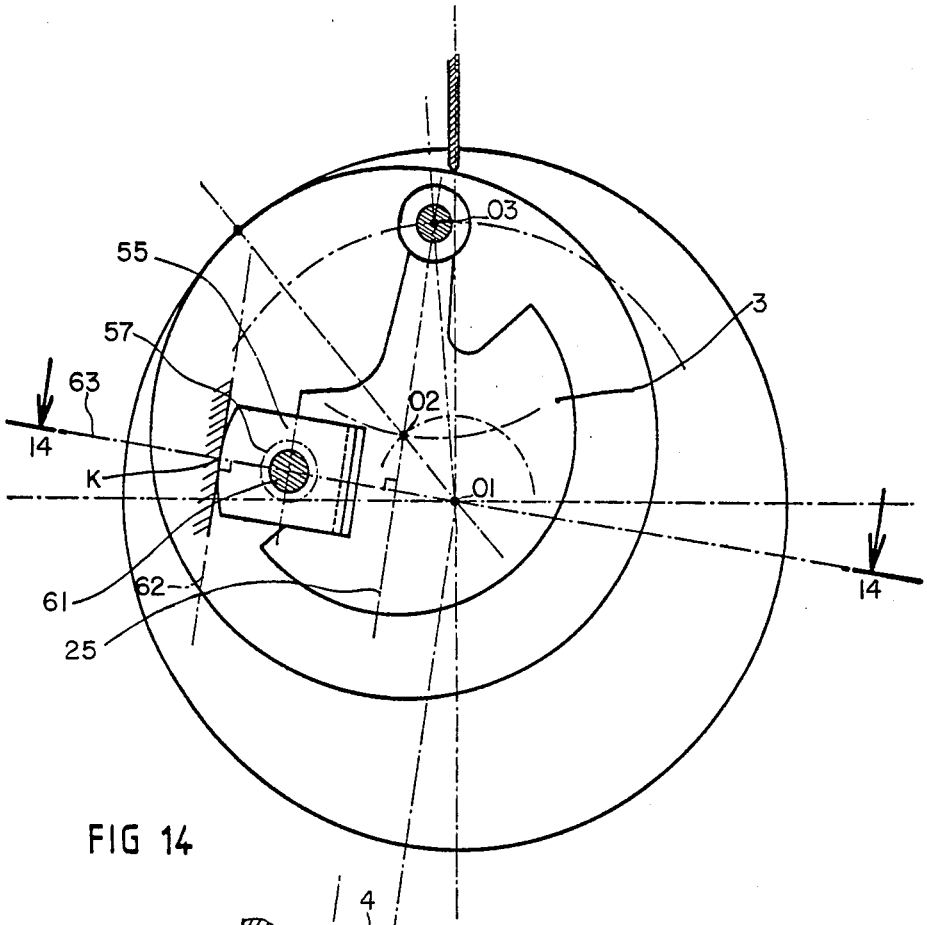
Figure 14:
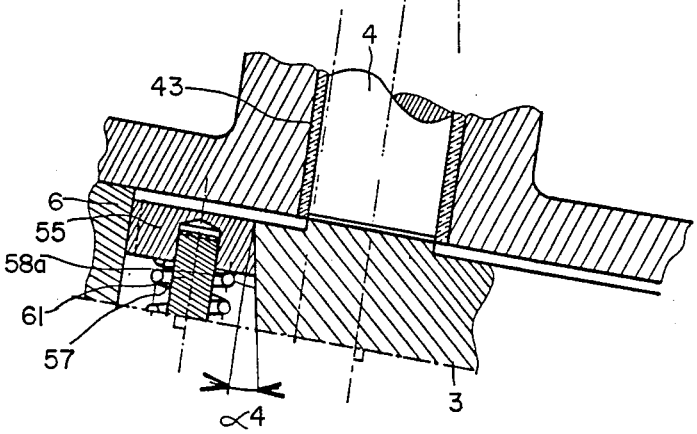

Other features of the machine of the invention will be clear from the following description of different embodiments given by way of examples and illustrated by the drawings in which:

FIG. 1 shows a longitudinal sectional view through 1—1 of FIG. 2 of the compressor, FIG. 2 is a cross sectional view through 2—2 of FIG. 1, FIG. 3 is a cross sectional view of another embodiment, FIG. 4 is a graph showing the variation of the reaction force Re at the sliding contact point E as a function of the angle of the crank w which the straight line $O_1E$ and the central axis $O_1G$ forms ($J=2.5$mm and $\alpha_1=36°$), FIG. 5 is a graph showing the variation of the angle $\alpha$, as a function of the play J, FIG. 6 is a graph showing the variation of the compression efficiency as a function of the engagement angle, FIG. 7 is a graph showing the variation of the maximum reaction force Re at the sliding contact point E as a function of the play J (reference 46 on the curve of FIG. 4), FIG. 8 is a graph showing the variation of the minimum reaction force Re as a function of the play (reference 47 on the curve of FIG. 4), FIG. 9 is a diagram of forces for a crank angle $O<w<w_1$, when the reaction force Re is positive, FIG. 10 is the diagram of forces for a crank angle $w_1$, when Re is zero (reference 45 in FIG. 4), FIG. 11 is a diagram of forces for a crank angle $w_2$, when Re is negative and at its minimum (reference 47 in FIG. 4), with positioning of the spring for compensating Re, FIG. 12 is a sectional view of the spring and of its housing through 12—12 of FIG. 11, FIG. 13 is a schematical cross sectional view showing the use of compensation wedges with transverse slope of another compressor variant, FIG. 14 is a partial view through 14—14 of FIG. 13 of a wedge assembly detail, FIG. 15 is a cross sectional view through 15—15 of FIG. 16 showing another wedge arrangement with axial slope, and FIG. 16 is a partial axial sectional view through 16—16 of FIG. 15.

The compressor of a refrigerating machine in accordance with the invention shown in FIGS. 1 and 2 comprises a central compressor body 2 having two external front 11 and rear 12 flanges, through which passes a drive shaft 4 with axis $O_1$. Body 2 defines a cylindrical chamber coaxial with shaft 4, whose internal wall 10 forms the rolling path of the piston.

Inside the cylindrical chamber, shaft 4 is interlocked with an excentric or crank 3. Furthermore, a rotary piston 5 with axis $O_2$ of a diameter less than that of the chamber is placed there inside, so as to be able to roll in contact with the wall of the chamber, whereas a mobile drive crown wheel 6 is mounted inside piston 5. so as to be able to slide with respect to the piston along the sliding surface 7.

The crown wheel 6 is provided with a fork joint 8, 9 and the end of crank 3 with a bore 24, so as to be able to couple the crown wheel 6 and the crank 3 together by means of a trunnion with axis $O_3$ which may freely rotate in the bore 24.

The virtual drive link for piston 5 is shown by the straight line connecting the center of the crown wheel and of piston $O_2$ to the center of trunnion $O_3$.

The body of compressor 2 comprises, under the cylinder head 34 provided with gasket 37, usual members such as intake and discharge ducts, this latter being provided with two valves 17, high pressure outlets 41, 42, as well as a separation flap 15 pivoting about its axis 16 and having sealing segments 54. Flap 15. separates the inside of the cylinder into a high pressure chamber 13 and a low pressure chamber 14, the contact point of the end of the flap and of piston 5 taking place through the bearing surface 29 of the bevelled flap, in the central axis of the cylinder at point G.

The usual equipment of a compressor comprises a lubricant reservoir 38 with its level checking plug 39. The drive shaft 4 rests in its bearings 43, 44 and is provided with rotary seals 31, a splasher 32 and a balancing weight 33. Centering feet 35 equip the rear and front flanges of the stator. Oil ways 40 serve for lubricating the plain journal bearing of the mobile crown wheel of the piston. Lateral sealing of piston 5 is provided by circular segments 36.

Engagement means for taking up the initial assembly play and the wear consist, in FIGS. 2 and 3, of a compensation spring working under compression whose axis of action 23, (FIG. 11) is perpendicular to the straight line connecting the center of the crown wheel 02 to the center of the trunnion $O_3$. One of the ends of spring 30 bears on a centering shoe 52, integral with the crown wheel 6 and the other in a centering recess 53 formed in the drive shaft 4.

The compressor of FIG. 3 is a variant of construction in which the piston 5 is mounted on a needle bearing 22 and the compensation device comprises a pair of wedges with conical slopes 55 urged by a clamping spring 57 with axis 61, the outer surface 60 of wedge 55 of rounded shape bearing on a contact shoe 59 integral with the crown wheel (see FIG. 14).

When wedging engagement of piston 5 against the wall 10 of the chamber is provided at the contact point E by resilient compensation means, such as wedges and springs (see FIG. 9), a straight line $O_1E$ may be plotted connecting the center $O_1$ of the shaft to point E. It is with respect to this straight line that the engagement angle $\alpha_1$ is defined between the straight line $O_1E$ and the straight line $O_1O_3$ connecting the center $O_1$ of the shaft to the center of the trunnion. The angle $\alpha_1$ is therefore the angle by which the axis of the trunnion $O_3$ is offset with respect to the straight line $O_1E$ in the rotational direction of the shaft.

The value of this angle must be judiciously chosen In fact, the angle $\alpha_1$ is related mathematically to the value of the play J between the piston and the wall of the chamber. This play J is calculated and measured when, with the effects produced by the resilient compensation means cancelled out, the axis of piston $O_2$ is situated in the alignment of the axes $O_1$ and $O_3$ of the shaft and of the trunnion, along the straight line of alignment of these axes. This play may be observed, when the crank is caused to pivot about axis $O_3$ for bringing the center of piston $O_2$ on the straight line $O_1O_3$.

The graph of FIG. 5 shows a curve 48 giving the variation of the play J in $10^1$ mm as a function of the angle $\alpha_1$ in radians. It can be seen that the variation is substantially linear for values of J greater than 1 mm. The values of J and $\alpha_1$ are related mathematically and may be calculated for given dimensions of the chamber, of the crank arm and other constructional parameters.

FIG. 4 shows, for a play of 2.5 mm corresponding to an angle $\alpha$ of about 36°, a variation of the reaction force Re expressed in decanewtons at the sliding contact point E of the piston on the wall of the chamber as a function of the crank angle w in radians, i.e. the instantaneous angular position of the straight line $O_1E$.

This curve shows a balance point 45 for a crank angle value $w_1$ to which the diagram of forces of FIG. 10 corresponds, where the reaction force Re at the contact point E is zero. The curve has a maximum at 46 corresponding to a value of the crank angle w situated between 0° and $w_1$ for which the reaction force Re at the contact point E is maximum.

Beyond the angle $w_1$, the direction of application of the force Re is reversed and the piston tends to lift from the rolling path. This negative reaction force Re has at 47 a minimum whose effect must be compensated for by using resilient compensation means such as springs or a combination of wedges and springs (see the diagram of forces in FIG. 11).

FIG. 6 shows a curve 49 of variations of the compression efficiency in percentages as a function of the engagement angle $\alpha_1$ in radians. The result is that the rising part of the curve corresponds to the low values of $\alpha_1$ on which theoretically the choice should be based. However, the reaction force Re, whose variations as a function of the crank angle w are shown in FIG. 4, may reach prohibitive values incompatible with the tolerable forces which can be imposed on the materials because of their resistance to breakage and rapid wear. For values of $\alpha_1$, equal to or less than 20° , the reaction on the drive shaft is too great and following an increase of the mechanical forces the efficiency decreases. The smaller $\alpha_1$ the higher the forces exerted on the piston and the trunnion and which generate energy losses by transformation into friction heat.

In FIGS. 7 and 8 have been shown curves 50 and 51 showing the variations of the forces Re expressed in decanewtons as a function of the value of the play J In $10^{-l}$ mm, corresponding respectively to the maximum reaction force at the contact point E (point 46 of the curve of FIG. 4) and to the maximum negative reaction force (point 47 on the same curve). It can be seen that the positive reaction force Re decreases when the play J increases. This force tends towards infinity for a zero play, which would lead the constructor to adopt a clearance as large as possible. However, since the force Re for an angle $w_2$ (FIG. 4) becomes more and more negative as shown in FIG. 8, there would be a tendency to choose on the contrary a value of J which is as small as possible.

It can be seen that the difference between positive Re and negative Re decreases with the play and reaches a level for a play of about 10 mm. The choice of J determines the value of the angle $\alpha_1$, since the angle $\alpha_1$ varies substantially linearly as a function of the play J for values of J greater than 1 mm (see FIG. 5).

In practice, for determining the play J or the angle $\alpha_1$, a range of angles $\alpha_1$ corresponding to the desired efficiency is chosen in FIG. 5. For reasons of strength of the materials mentioned above, $\alpha_1$ will be chosen greater than 20° or better still greater than 30°. So as to know the positive and negative reactive forces to which the materials will be subjected, diagrams of forces will be plotted, according to FIG. 4, for each of the chosen values of the angle $\alpha_1$. The maximum value of the positive reactive force Re to which the materials may be exposed will be taken into account on the one hand, and on the other the maximum value of the negative force Re, for the higher it is the stronger will have to be the resilient compensation means to be used with a limit threshold which represents the extreme compensation possibilities using springs because of their mechanical strength. Thus, the curve will be chosen where the positive value Re and the negative value Re are acceptable for the above mentioned reasons.

In FIGS. 9, 10 and 11, are shown the diagrams of forces for different crank angles w exerted in a compressor, where the engagement angle $\alpha_1$ is 32°64′ and the play 5 mm.

These diagrams correspond respectively, as far as FIG. 9 is concerned to any crank angle w situated between 0° and $w_1$ (FIG. 4), that is to say where the force Re is positive and in so far as FIG. 10 is concerned to a balance angle $w_1$ (point 45, FIG. 4) just before lifting of the piston from its rolling path and, in so far as FIG. 11 is concerned, to an angle between $w_1$ and $w_2$ (point 47, FIG. 4) in the lifting zone where the negative Re force is maximum.

In these Figures, Rc represents the circle described by the radius of the cylinder Rc having $O_1$ for center, Rp the circle described by the radius of piston Rp having $O_2$ for center, Rf the circle described by the center of the trunnion $O_3$, Rcp the circle described by the center of the piston $O_2$, and R the portion of the circle described by the center of the piston $O_2$ pivoting about the center of the trunnion $O_3$.

In the case of FIG. 9, the piston is balanced for a crank angle w between 0° $w_1$ (FIG. 4). It is subjected to a resulting torque of the positive force FPc which represents the force of the pressure reigning in chamber HP and passing through the center of piston $O_2$. The letter a designates the arm of the lever for calculating the torque acting on the axis $0_3$ of the trunnion and which holds the piston applied against its rolling path for a rotation of the crank shaft corresponding to an angle from 0° to $w_1$ in radians .

FIG. 10 shows the piston balanced for an angle w equal to $w_1$, i.e. just before lift off of the piston.

FIG. 11 shows a diagram of forces for an angle w between $w_1$ and $w_2$, i.e in the lift off zone. After passing through the angle $w_1$, the force Re becomes negative and reaches its maximum for an angle $w_2$. This force is exerted through the lever arm b and forms a torque tending to lift the piston off from its point of contact E with the cylinder. To avoid lift off of the piston, the effect of the negative force Re is offset by the action of one or more springs 30 (FIGS. 11 and 12), whose torque $FR \times O_1O_3 \cos \alpha_3$ is equal to the torque Re x b.

The face 62 by which sprinq 30 bears on the crown ring is parallel to the straight line 25 connecting together the centers of piston $O_2$ and of trunnion $O_3$ and its straight line of action 23 passing through the center $O_1$ of the shaft is perpendicular to the straight line 25.

Calculation of the force of the spring must take several factors into account, such as the working pressure in chamber HP and the dimensions of the chamber and of the piston.

Spring 30 is disposed upstream of the point of contact E with respect to the direction of rolling of the piston (FIG. 2), its axis 67 passes through the axis $O_1$ of the shaft and is perpendicular to the straight line 25. It is housed between a centering stud 65 fixed to the crown wheel and a cylindrical housing with spot facing 64 formed in the crank and whose bottom 66 is parallel to the straight line 25 (FIG. 12).

The device using one or more springs for holding the piston applied against its rolling path and for offsetting the negative force Re represents a first solution for wedging the piston. Other compensation and wedging means consist in using wedges with conical slopes urged by one or more springs allowing progressive wedging adjustment.

In the embodiment shown in FIGS. 13 and 14, between crank 3 and the crown wheel 6 is formed a concave housing formed by two sloping longitudinal flat portions 58 for housing a pair of wedges 55 with conical slopes 58 of opposite directions. For this, the block of the crank has at this position of the housing two slopes, the angle of orientation of each one corresponding to the slope of the wedge which is housed therein. The conical slopes of the housing and of the wedges are sloped through an angle $\alpha_4$ with respect to the axis $O_1$ of shaft 4. At the two transverse ends of the housing are accomodated the wedges 55. The wedge faces opposite the faces sloping through angle $\alpha_4$ and bearing on a flat portion 62 or shoe which the crown wheel 6 comprises at this position are convex and rounded so that the wedges bear on their shoes along a generatrix designated by K. The longitudinal plane of symmetry 63 of the wedges passes through the center 1. The two wedges 55 are urged in opposite directions by a spring 57 working under compression whose centering axis 61 is accomodated at both ends in the wedges. The thrust exerted by wedges 55 against the shoe 62 of the crown wheel is perpendicular to the straight line connecting together the axis of the piston $O_2$ and the axis of the trunnion $O_3$.

Another embodiment of wedges is shown in FIGS. 15 and 16. Instead of being orientated through angle $\alpha_4$ with respect to axis $O_1$ of shaft 4, the slope 71 of wedge 70 is slanted transversely with respect to the axis $O_1$ and particularly through an angle $\alpha_5$ with respect to the straight line connecting together the center $O_3$ of the trunnion and the center $O_2$ of the piston. For this, the housing formed for the wedge is included between the longitudinal flat portion 71 of the crank 3 and the flat portion 72 which the bore of the crown wheel 6 comprises. Wedge 70, one longitudinal face of which is slanted by angle $\alpha_5$, is bored on its lateral face with two blind housings 73 for housing the ends of the springs 74 working under compression, whose opposite ends are retained by centering studs 75 placed on a flat portion of the crown wheel 6.

The action of the wedges is exerted along a straight line which is transversal with respect to the axis of shaft 4 and results in driving the crown wheel 6 of the crank back in a direction perpendicular to said straight line.

The application described for the machine of the invention in the field of compressors in no wise excludes other applications using the principle described, such as in the fields of explosion engines, vacuum pumps, energy recuperators or pneumatic or hydraulic brakes.

I claim:

1. A rotary piston machine, more especially a rotary piston compressor, comprising a cylindricaI chamber in which are disposed a shaft with axis $O_1$ coaxial with said chamber, an eccentric part or crank integral with shaft an annular rotary piston able to roll in contact with the wall of the chamber and a crown wheel for driving the piston mounted thereinside, so as to be able to slide with respect to the piston, the piston being wedged on its rolling path by resilient compensation means bearing on the crank or on the shaft and on the bore of the crown wheel, the machine further comprising a flap dividing the free space about the piston into two compartments with variable volume, characterized in that the crown wheel is rotated by means of a trunnion mounted in a fork joint coupling together the crank and the crown wheel so as to be able to pivot about a common axis.

2. The machine according to claim 1, wherein the trunnion is mounted in a bore with axis $O_3$ of the crank and in a fork joint integral with the crown wheel.

3. The machine according to claim 1, wherein when the piston is wedged against the wall of the chamber at the point of contact E by said resilient compensation means, the axis $O_3$ of the trunnion is offset in the direction of rotation of the shaft by an angle $\alpha_1$ with respect to this point of contact E, the angle $\alpha_1$ being the angle which the straight line connecting the axis $O_1$ of the shaft with the point E makes with the straight line connecting the axis $O_1$ of the shaft with the axis $O_3$ of the trunnion.

4. The machine according to claim 3, wherein the value of the angle $\alpha_1$ is chosen as a function of play J between the piston and the wall of the chamber measured when, in the absence of the effects produced by the resilient compensation means, the axis of the piston $O_2$is located in the alignment of the axes $O_1$ of the shaft and $O_3$ of the trunnion along the straight line aligning these axes.

5. The machine according to claim 3 or 4, characterized in that, with the values of $\alpha$ and J mathematically related and so as to avoid subjecting the materials to mechanical forces which are too high, an angle $\alpha_1$ is chosen, as a function of the working pressure, of the speed of rotation then of the dimensions of the piston and of the chamber, greater than the angle of 20° to which a play J of about 1 mm corresponds.

6. The machine according to claim 1, wherein the resilient wedging means are formed by at least one spring mounted traversely upstream of the point of contact E with respect to the direction of rotation of the piston, bearing on the crank and on the crown wheel so that the straight line of action of the spring passes through the axis $O_1$ of the shaft and is perpendicular to the straight line connecting the center $O_2$ of the piston with the center $O_3$ of the trunnion.

7. The machine according to claim 6, wherein the face of the spring bearing on the crown wheel is parallel to the straight line connecting the center $O_2$ of the piston with the center $O_3$ of the trunnion.

8. The machine according to claim 6, wherein the spring is housed between a centering stud fixed to the crown wheel and a cylindrical housing with spot facing formed in the crank, whose bottom is parallel to the straight line connecting $O_2$ with $O_3$.

9. The machine according to claim 6 wherein the resilient compensation means are formed by at least one wedge with conical slope urged by a spring working under compression along a straight line of action transversal with respect to the axis $O_1$ of the shaft (4), the wedge being housed in the housing between the crank and the crown wheel, one wall of which has a conical slope.

10. The machine according to claim 9, characterized in that one of the longitudinal faces of the crank has two longitudinal concave flat portions (58) sloping at an angle $\alpha_4$ with respect to the axis $O_1$ of the shaft and forming a housing with the bore of the crown wheel (6), two wedges (55) being housed at the two transverse ends of said housing, each one having an inner face sloping at an angle $\alpha_4$ corresponding to that of the sloping flat portion (58), a spring (57) working under compression being disposed between, the wedges (55).

11. The machine according to claim 9 or 10, characterized in that the part of the crown wheel on which the wedges bear has a flat portion (62) forming a shoe, whereas the outer face of each wedge bearing on said shoe has a rounded portion.

12. The machine according to claim 9, characterized in that between the bore of the crown wheel and the crank is disposed a housing for a wedge (70) with longitudinal sloping face, the slope (71) of the housing on the crank side being sloped transversely by an angle $\alpha_5$ with respect to the straight line connecting the center $O_2$ of the piston with the center $O_3$ of the trunnion, the action of the wedge (70) urged by at least one spring (74) being exerted along a straight line transversal with respect to the shaft (4).

13. The machine according to claim 12, characterized in that a lateral face of the wedge (70) is pierced with at least one blind housing (73) in which is accomodated one end of the spring (74), the other end of the spring bearing on a centering stud (75) integral with a flat portion (72) of the crown wheel (6).

* * * * *

UNITED STATES PATENT AND TRADEMARK OFFICE

CERTIFICATE OF CORRECTION

PATENT NO. : 4,759,697

DATED : July 26,1988

INVENTOR(S) : Jean JANICKE

It is certified that error appears in the above-identified patent and that said Letters Patent is hereby corrected as shown below:

On the face of the patent, the patent should read --Assignee: Tecnalor S.A., Hussigny, France--.

Signed and Sealed this

Twenty-eighth Day of February, 1989

*Attest:*

DONALD J. QUIGG

*Attesting Officer*

*Commissioner of Patents and Trademarks*